United States Patent [19]

Van Ooij

[11] 4,218,517

[45] Aug. 19, 1980

[54] ARTICLE OF MANUFACTURE HAVING A METALLIC SURFACE COATED WITH AN ELASTOMER AND AN INTERMEDIATE COBALT-COPPER ALLOY COATING TO IMPROVE THE ADHESION OF THE ELASTOMER

[75] Inventor: Willy J. Van Ooij, Dieren, Netherlands

[73] Assignee: Akzo NV, Arnhem, Netherlands

[21] Appl. No.: 881,677

[22] Filed: Feb. 27, 1978

[30] Foreign Application Priority Data

Mar. 11, 1977 [NL] Netherlands ..... 7702643

[51] Int. Cl.[2] ..... B32B 15/06

[52] U.S. Cl. ..... 428/614; 138/145; 138/172; 152/151; 152/359; 198/847; 428/462; 428/463; 428/466; 428/625; 428/677; 428/679

[58] Field of Search ..... 428/624, 625, 626, 681, 428/674, 675, 676, 677, 678, 679, 466, 462, 463, 614; 152/361 R, 151, 359; 198/847; 138/145, 146, 172

[56] References Cited

U.S. PATENT DOCUMENTS

| | | | |
|---|---|---|---|
| 2,240,805 | 5/1941 | Semon | 154/2 |
| 2,296,838 | 9/1942 | Domm | 428/625 |
| 2,939,207 | 6/1960 | Adler | 428/625 |
| 3,522,139 | 7/1970 | Redmond | 428/626 |
| 3,728,192 | 4/1970 | Kindle et al. | 156/306 |
| 3,847,727 | 11/1974 | Kindle et al. | 161/215 |
| 4,068,041 | 1/1978 | Swartz et al. | 428/625 |

FOREIGN PATENT DOCUMENTS

| | | |
|---|---|---|
| 2132359 | 11/1972 | France . |
| 1333025 | 10/1973 | United Kingdom . |

OTHER PUBLICATIONS

Hansen, M.; *Constitution of Binary Alloys* 2 Ed. MacGraw Hill, pp. 469, 470, 471 (1958).

Klement, W. Jr.; "Solid Solutions in Gold-Cobalt and Copper-Cobalt Alloys"; *Trans. Met. Soc. AIME,* vol. 227 pp. 965-970 (1963).

Kneller, E., "Magnetic Moment of Co-Cu Solid Solutions with 40-85% Cu" J. of Applied Physics Supp. to vol. 33 No. 3 pp. 1355-1356 (3/62).

Gleiter, Von Herbert; "Die Verfestigung von Legierungen mit Nitchtschneidbaren Teilchen", Z Metallkunde, vol. 58 pp. 236-237 (1967).

Brenner, A. *Electrodeposition of Alloys* p. 576.

Subrahmanyam, D. V., et al.; "Electrodeposition of Copper-Cobalt Alloys", *Metal Finishing,* vol. 61 pp 68-69 (5/63).

Subrahmanyam, D. V. et al.; "Electrodeposition of Copper-Cobalt Alloys from the Pyrophosphate Bath" *Electroplating and Metal Finishing,* vol. 20 pp. 44-49 (2/67).

Fedot'ev. N. P., et al.; "Electrodeposition of Cobalt-Copper Alloys " *Zhurnal Prikladnoi Kkimii* pp. 424-427 (translated) vol. 41 (2/68).

van Ooij, W. J., "Mechanism of Rubber-to-Brass Adhesion" Kautschuk and Gummi-Kunststoffe vol. 30 pp. 739-745, 833-838 (1977).

*Primary Examiner*—L. Dewayne Rutledge
*Assistant Examiner*—Michael L. Lewis
*Attorney, Agent, or Firm*—Stevens, Davis, Miller & Mosher

[57] ABSTRACT

The adhesion of an elastomer such as rubber to a metal surface is improved by coating the metal surface first with an alloy containing cobalt and copper, applying the elastomer to the coated metal surface and vulcanizing the elastomer.

10 Claims, 7 Drawing Figures

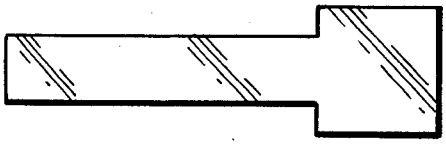
FIG. 1
FIG. 2
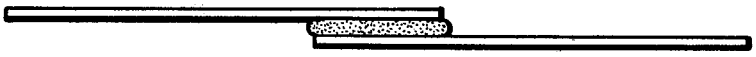
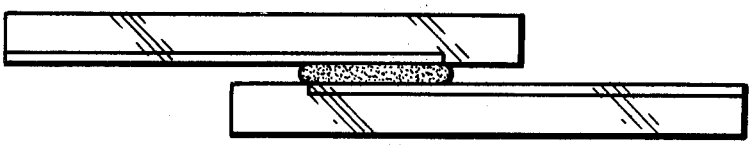
FIG. 3
FIG. 4
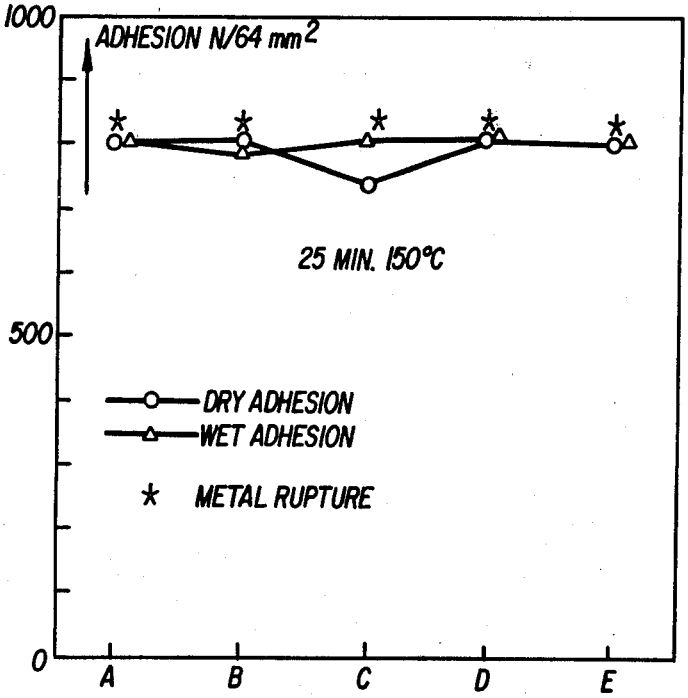

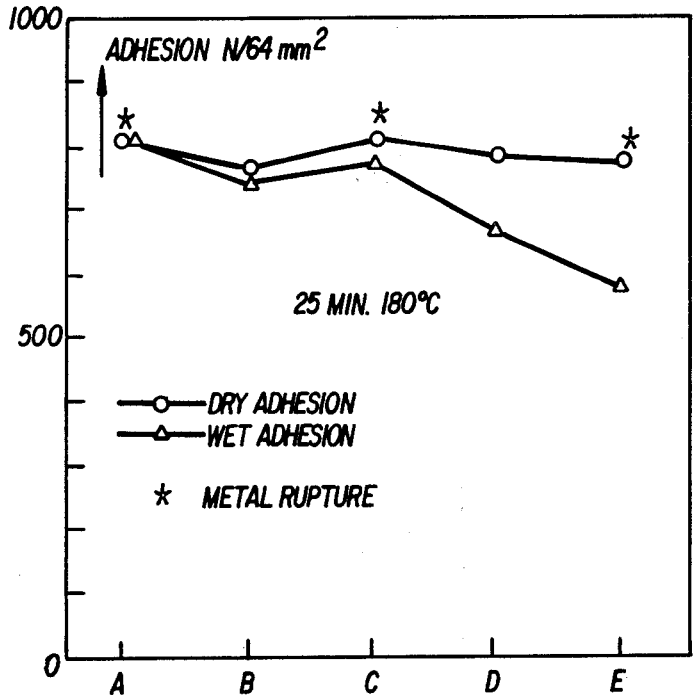
FIG. 5
FIG. 6
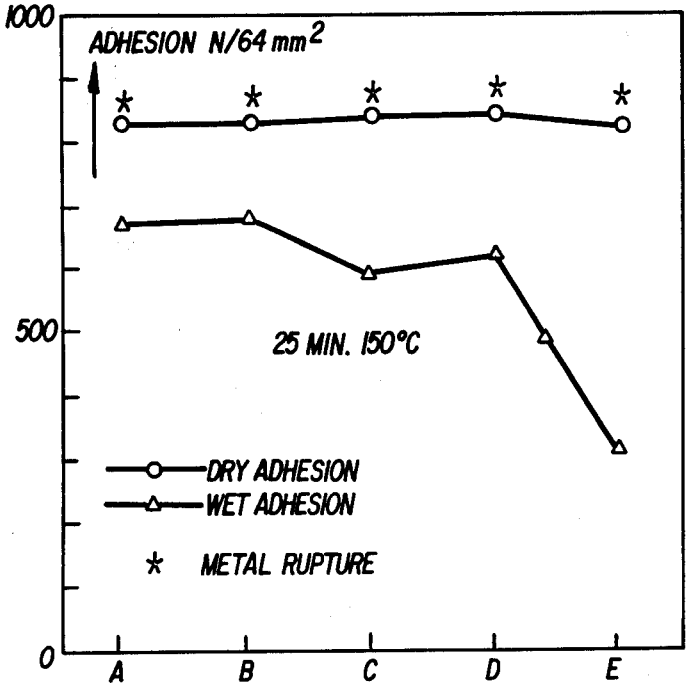

ARTICLE OF MANUFACTURE HAVING A METALLIC SURFACE COATED WITH AN ELASTOMER AND AN INTERMEDIATE COBALT-COPPER ALLOY COATING TO IMPROVE THE ADHESION OF THE ELASTOMER

This invention relates to an article of manufacture having a metal surface coated with a metallic alloy to which an elastomeric material is adhered by vulcanization. The invention also provides a process for the manufacture of such an article.

An article of the type described above and processes for the manufacture thereof are known. In the automobile industry, for example, steel cords are used extensively for the reinforcement of rubber such as in vehicle tires. The steel cord is composed of a number of steel wires coated with a thin layer of brass. The cords composed of brass-coated steel wires or filaments are first contacted with unvulcanized rubber. Subsequently, the rubber is vulcanized, resulting in a bond between the rubber and the brass coating. The steel cords coated with brass generally provide a reasonable degree of adhesion, provided that the various process conditions, especially during vulcanization, and the properties and/or the state of the starting rubber are accurately controlled.

It is generally known that the tires of automobiles are subjected to high loads, particularly during cornering and at high speeds, and that they must have a long useful life. For the steel cord embedded in the automobile tire to function properly as a reinforcement there must be a firm bond between the cord and the rubber. In other words, the adhesion between steelcord and rubber plays an essential role. In this connection both the manufacturers of automobile tires and the manufacturers of steelcord have for many years carried out a great deal of research work to improve the adhesion between cord and rubber.

It is an object of this invention to provide metal articles having an adherent elastomeric coating. Another object of the invention is to provide a process for making improved metal articles having an elastomeric coating which is securely adhered to the surface of the metallic article. A further object of the invention is to provide a method for improving the adhesion of an elastomer to a metal base such as a steel wire.

Other objects will become apparent from the following description with reference to the accompanying drawings wherein:

FIG. 1 is a plan view of steel test plates of the type used in obtaining the data in FIGS. 4, 5, 6 and 7 and Tables I, II and III;

FIG. 2 is a side view of the plates of FIG. 1 showing an intermediate layer of rubber between surfaces having the alloy coating of the invention;

FIG. 3 is also a side view of an assembly of plates coated with the alloy of the invention and bonded together with an intermediate layer of rubber;

FIGS. 4, 5, 6 and 7 are tests results obtained with metal plates of the type illustrated in FIGS. 1, 2 and 3.

Figure 7:
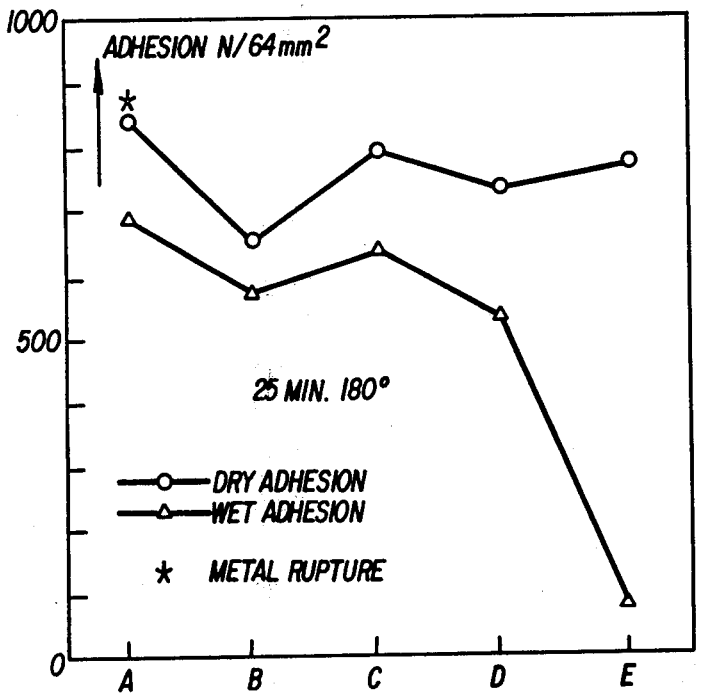

According to the invention it has surprisingly been found that the adhesion of an elastomer such as rubber to a metal surface such as steel can be improved if instead of the abovementioned coating of brass the metal surface is coated with a cobalt-copper alloy before the elastomer is applied. In other words, the invention provides an article having a metal surface coated with an alloy containing cobalt and copper to which an elastomeric material is bonded by vulcanization. According to the invention favorable results are obtained if the cobalt-copper alloy contains 5 to 50 percent by weight of copper, preferably 10 to 30 percent by weight of copper and the balance cobalt. The coating thickness of the cobalt-copper alloy is 30 to 750 nm (nanometer).

Although the material for the base surface of the article to be coated with an alloy may be any suitable metal such as one selected from a group of various metals resistant to vulcanization temperatures, such as aluminum, copper and the like, the most favorable results are obtained with a steel surface.

Although all aritcles having a metal surface coated with an elastomer are contemplated broadly, a preferred embodiment of the invention is an article in the form of a steel or other metal wire or filament having a diameter in the range of from 0.05 to 0.75 mm. According to the invention a number of these filaments may be advantageously formed into a cord or bundle.

It should be added that by cobalt-copper alloys are to be understood here one- or multi-phase, practically solid solutions of copper in cobalt or intermetallic compounds, with the copper atoms mainly occupying crystal lattice positions of the cobalt. It has been found that the cobalt-copper alloy according to the invention has a face-centered cubic structure.

The present invention is to be considered of particular advantage for articles of elastomeric material containing reinforcing elements which are characterized according to the invention in that they are formed by metal wires and/or cords coated with a cobalt-copper alloy. According to the invention a preferred embodiment for such an elastomeric object is a vehicle tire. The elastomeric object according to the invention may be also in the form of a conveyor belt or flexible tube. Favorable results are also obtained with an article coated with a cobalt-copper alloy in the form of a plate, pipe or beam. The invention also comprises a process for the manufacture of an object which is coated with a metallic alloy which is subsequently bonded to an elastomeric material by vulcanization, which process is characterized in that the alloy is a cobalt-copper alloy containing 5 to 50 percent by weight of copper, and preferably 10 to 40 percent by weight of copper, having a coating thickness of 30 to 750 mm. A simple process for the manufacture of the above object is, according to the invention, characterized in that the cobalt-copper alloy is deposited electrolytically, preferably from a pyrophosphate bath or from a cyanide bath. A preferred embodiment of the process of the invention is characterized in that the coating is applied to a metallic base surface at a current density of at least 15 amperes/dm$^2$, with the current efficiency being at least 50%. By current efficiency is to be understood the proportion of the total current, expressed as a percentage, that is effective in the depositing of metal ions. It is preferred that the coating of steel wires according to the invention should be carried out at a current density of 20–25 amps/dm$^2$.

Another process of manufacturing the above-mentioned object, which is of particular advantage for non-electrically-conductive surfaces, is according to the invention characterized in that the cobalt-copper alloy coating is applied by a vacuum vapor deposition process. The elastomeric material to be used in the various objects according to the invention may be composed of various substances or combinations of substances, provided that the elastomeric material has such properties which make it display a more or less elastic deformation behavior and in any case permit it to be vulcanized with sulfur. The component substances of the elastomeric material may be formed by synthetic and natural polymers displaying plastic deformation behavior before vulcanization and rubber-elastic behavior after vulcanization, as is more particularly the case with synthetic and natural rubber. As examples of such polymers may be mentioned polypentadiene, polybutadiene, poly(olefins), polyisoprene, poly(butadiene styrene), poly(butadiene-acrylonitrile), poly(ethylene-propylene), poly(isobutene-isoprene), polychloroprene.

Moreover, to the elastomeric material there may have been added the usual fillers, additives and vulcanizing agents such as carbon black, particular substances or oils for the processing or softening of rubber, antioxidants, sulfur, zinc oxide, stearic acid, and accelerators.

It has been found that the adhesion between rubber and the surface coated according to the invention with a cobalt-copper alloy is not adversely affected by the presence of moisture in the elastomer. As the presence of moisture in the rubbers to be used in the vulcanization process is often inevitable and moreover considerable variations in the moisture content of the rubber and in the air may occur, the use of a less moisture-sensitive adhesive alloy forms a great improvement over the prior art.

It has further been found that the adhesion between rubber and the surface coated according to the invention with a cobalt-copper alloy is hardly or little impaired by overvulcanization, i.e., a vulcanization process carried out at too high a temperature, for instance 180° C. instead of 150° C., and/or lasting a too long time. As such overvulcanization is often difficult to avoid, the present invention offers a considerable advantage also in this respect. Moreover, the aging behavior or in other words the deterioration with time of the bond between the cobalt-copper alloy and rubber is more favorable than that of the bond between brass and rubber. Also the corrosion resistance of steel coated with a cobalt-copper alloy is better than that of steel coated with brass, which is a considerable advantage particularly in the use of the steel in automobile tires.

To illustrate the present invention various experiments were carried out; their results are reported in the following Tables I, II and III.

Table I

Adhesion to rubber of steel sample plates coated with a cobalt-copper alloy.

| Thickness of the alloy coat (nm) | % Cu | Dry adhesion(1) Vulcanization temperature 150° C. | Dry adhesion(1) Vulcanization temperature 180° C. | Wet adhesion(2) Vulcanization temperature 150° C. | Wet adhesion(2) Vulcanization temperature 180° C. |
|---|---|---|---|---|---|
| | 2 | 470 | 660 | 310 | 325 |
| | 17 | 665 | 675(3) | 695 | 535 |
| | 24 | 785 | 800 | 540 | 455 |
| 35 | 35 | >790 | >795 | 600 | 540 |
| | 52 | 780 | 780 | 480 | 275 |
| | 70 | >640 | >640 | 345 | 370 |
| | 2 | >670 | >655 | 575 | 540 |
| | 11 | >670 | >655 | >660 | 590 |
| 110 | 20 | >800 | >805 | >795 | 710(4) |
| | 28 | >710 | >655 | >707 | 710(4) |
| | 2 | >675 | >660 | 505 | 500 |
| | 11 | >785 | >780 | >782 | 735(4) |
| 220 | 18 | 560 | 785 | 790 | 780(4) |
| | 26 | 750 | 720 | >740 | 725(4) |

Table II

Adhesion to rubber of steel sample plates coated with a copper-zinc alloy.

| Thickness of the alloy coat (nm) | % Cu | Dry adhesion(1) 150° C. | Dry adhesion(1) 180° C. | Wet adhesion(2) 150° C. | Wet adhesion(2) 180° C. |
|---|---|---|---|---|---|
| 120 | 68 | >810 | 114 | 245 | 420 |
| | 75 | >810 | >810 | 505 | 305 |
| | 53 | 650 | 235 | 610 | 290 |
| 250 | 71 | >810 | 180 | 515 | 470 |
| | 82 | 510 | 405 | 570 | 215 |

The reference numerals in the Tables I and II have the following meaning:

(1) in N/64 mm$^2$; vulcanization times 25 minutes;

(2) rubber stored at 90% relative humidity for not less than 10 days;

(3) <=rupture of the metal plate;

(4) 100% Rubber Coverage, i.e., the adhesive strength between alloy and rubber was higher than the strength of rubber.

The coatings mentioned in Tables I and II were deposited electrolytically from a pyrophosphate bath on steel plates according to FIG. 1. Each steel plate consisted of a square end measuring 8×8 mm and an elongated clamping portion measuring 20×8 mm. Between the square 8×8 mm ends of two steel plates (see FIG. 2) there was placed a layer of rubber and the two plates were subsequently placed in a vulcanizing press and subjected to a high mechanical pressure.

Prior to vulcanication the layer thickness of the piece of rubber was about 2 mm, and after vulcanization about 0.5 mm. The metal plates vulcanized pairwise to each other were then at their free ends clamped in an Instron tensile tester, and the adhesion in N/64 mm$^2$ given in the tables was determined.

Table III

Adhesion to rubber(1) of steel plates coated with a cobalt-copper alloy and of a brass plate under different conditions of the pyrophosphate bath containing cobalt and copper.

| Material | Plating(4) conditions | Dry adhesion(2) vulcanization temperature 150° C. | Dry adhesion(2) vulcanization temperature 180° C. | Wet adhesion(3) vulcanization temperature 150° C. | Wet adhesion(3) vulcanization temperature 180° C. |
|---|---|---|---|---|---|
| CoCu | Flat cathode 60° C.; no AC(5) | 960 | 1030 | 560 | 730 |
| CoCu | Rotating cathode; 50° C.; no AC | 900 | not determined | not determined | 530 |
| CoCu | Rotating cathode; 60° C.; no AC | 780 | not determined | not determined | 720 |
| CoCu | Rotating cathode; 50° C.; 10 g/l AC | 890 | not determined | not determined | 610 |
| CoCu | Rotating cathode; 60° C.; 10 g/l AC | 960 | not determined | not determined | 570 |
| brass plate(6) | — | 890–970 | 730–740 | 370–470 | 30–180 |

The reference numerals in Table III have the following meaning:

(1) rubber sample of over 3 months old;

(2) adhesive strength measured with the aid of improved test plates according to FIG. 3;
(3) rubber stored for 3 months at 90% relative humidity;
(4) best observed adhesion levels for various samples containing 13.6–67.5 percent by weight of copper in a coating thickness range of 45–668 nm and prepared by means of a rotating cathode (35–500 r.p.m);
(5) AC = ammonium citrate;
(6) lowest and highest values found for brass plate.

From Tables I and III and from a comparison of these tables with Table II it appears that the adhesion between rubber and a surface plated according to the invention with a cobalt-copper alloy is better than in the case of a brass-plated surface. Particularly improved are the adhesion to moist rubber and the adhesion obtained during overvulcanization. The adhesion tests, the results of which are listed in the Tables I, II and III, were carried out with a particular commercially available type of rubber used for the manufacture of automobile tires. Tests were also carried out on various types of rubber by varying the sulfur content from 1–11 phr. These variations in the sulfur content dit not lead to any considerable change in adhesion. It should be added that 1 phr = the number of parts by weight of sulfur per 100 parts by weight of rubber without any additives.

Moreover, test plates were prepared using 5 different kinds of commercially available rubber mixtures A, B, C, D and F used by different firms for the manufacture of automobile tires. The results of these tests, too, confirmed the above-mentioned favorable adhesion properties as a result of the use of the cobalt-copper coating according to the invention.

The results of these tests with 5 different kinds of rubber are given in the FIGS. 4, 5, 6 and 7. On the horizontal axes therein are plotted the rubbers A, B, C, D and E, and on the vertical axes the adhesion to rubber in N/64 $mm^2$ after vulcanization.

The FIGS. 4 and 5 refer to tests with steel plates of the type indicated above electrolytically plated with a cobalt-copper alloy to a coating thickness in the range of 45–380 nm and a copper content in the range of 13.6 to 36.9 percent by weight. The FIGS. 4 and 5 mention both the adhesion to dry and to moist rubber. FIG. 4 gives the results obtained after vulcanization for 25 minutes at 150° C., and FIG. 5 shows the results obtained after 25 minutes vulcanization at 180° C. The FIGS. 6 and 7 refer to tests with solid brass plates to which rubber had been bonded by vulcanization.

The FIGS. 6 and 7 both show the results for the adhesion to dry and to moist rubber. FIG. 6 mentions the results obtained after vulcanization for 25 minutes at 150° C., and FIG. 7 gives the results obtained after 25 minutes vulcanization at 180° C. Comparison of the FIGS. 4, 5, 6 and 7 teaches that the cobalt-copper coating according to the invention provides such adhesion to different kinds of rubber and is distinctly less likely to be affected by the moisture condition of the rubber and overvulcanization.

Tests were also carried out to find out to what extent adhesion is affected by temperature. For that purpose adhesion was measured at temperatures between 0° and 200° C. It was found that in this respect the level of adhesion to rubber of objects plated with a cobalt-copper alloy is approximately equivalent to the adhesion level of objects plated with brass. It was further found that steel filaments having a diameter of about 2 mm and plated with said thin coating of cobalt-copper alloy can in a number of drawing stages be reduced to a diameter of a few tenths of a millimeter without the cobalt-copper alloy being segregated and without a great loss of alloy in the dies. Favorable results are therefore expected in adhesion tests.

It should be added that in U.S. Pat. No. 2,939,207 it has been proposed that a ferrous core should be provided with a corrosion resistant coating of zinc, cadmium or tin, to which there is applied a coating of nickel, cobalt or antimony, which is finally provided with a metallic coating of copper, copper-zinc, copper-cadmium or copper-tin which adheres to rubber.

In U.S. Pat. No. 2,323,890 it has been suggested that the zinc of a coating of zinc and copper on drawn metal wire should be replaced by tin, lead or cadmium.

Further, U.S. Pat. No. 2,240,805 proposes that to improve the adhesion of rubber to a metal object the metal should be plated with a cobalt coating. It also states that the cobalt surface may, moreover, contain other metals, such as iron, copper and zinc. Such metals, however, are not contained in an alloy along with cobalt.

With the scope of the present invention various modifications may be made.

In the case of steel filaments the cobalt-copper alloy may be applied to filaments drawn to a diameter of, say, 1.0–1.5 mm, as is practiced with brass.

The filaments coated with the alloy are then further drawn in various stages until they have the desired final diameter of, say, 0.25 mm.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A steel wire for reinforcing a sulphur vulcanizable elastomeric article, said steel wire being covered with a thin coating of a copper-cobalt alloy with a face-centered cubic structure, said alloy containing 10 to 70 percent by weight of copper and the balance cobalt, said coating being provided to improve adhesion of the elastomer to the wire, the thickness of the alloy coating being from about 30 to about 750 nm and the total diameter of the wire being within the range of from 0.05 to 0.75 mm.

2. The article of claim 1 in the form of a vehicle tire.

3. The article of claim 1 in the form of a conveyor belt.

4. A cord or thread bundle as a reinforcement for a sulphur vulcanizable elastomeric article, said cord or bundle being entirely or partly composed of a number of metal wires of claim 1.

5. An elastomeric article reinforced with the metal wire of claim 1.

6. An elastomeric article reinforced with the cord of claim 4.

7. As a new article of manufacture, a vulcanized-shaped elastomeric article having embedded therein and bonded to the elastomer at least one steel wire coated with an alloy of cobalt and copper containing from 10 to 40 weight percent copper and the balance cobalt said coating being from about 30 to about 750 mm thick which coating improves the adhesion of the elastomer to the wire.

8. The article of claim 7 which is a vehicle tire.

9. As a new article of manufacture, a vulcanized-shaped elastomeric article having embedded therein and bonded to the elastomer at least one steel wire coated with an alloy of cobalt and copper containing from 10 to 70 weight percent copper and the balance cobalt said coating being from about 30 to about 750 mm thick which coating improves the adhesion of the elastomer to the wire.

10. The article of claim 9 which is a vehicle tire.

* * * * *